US007972169B1

(12) United States Patent
Mulbrook et al.

(10) Patent No.: US 7,972,169 B1
(45) Date of Patent: Jul. 5, 2011

(54) PASSIVE ELECTRICAL COMPONENT WITH A BODY WITH I/O STRUCTURE INCLUDING GROUND AT TWO OPPOSITE CORNERS OF THE BODY

(75) Inventors: Mark M. Mulbrook, Marion, IA (US); Robert L. Palandech, Marion, IA (US); William L. Cronbaugh, Center Point, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 12/843,261

(22) Filed: Jul. 26, 2010

(51) Int. Cl.
*H01R 13/72* (2006.01)

(52) U.S. Cl. ..... 439/501

(58) Field of Classification Search ..... 439/501, 439/502, 503, 492, 344
See application file for complete search history.

(56) References Cited

U.S. PATENT DOCUMENTS

| | | | | |
|---|---|---|---|---|
| 5,468,159 | A * | 11/1995 | Brodsky et al. | 439/501 |
| 6,736,661 | B2 * | 5/2004 | Homer | 439/344 |
| 7,125,282 | B2 * | 10/2006 | Huang | 439/501 |
| 7,207,833 | B2 * | 4/2007 | Jeong | 439/501 |

* cited by examiner

*Primary Examiner* — Chandrika Prasad
(74) *Attorney, Agent, or Firm* — Matthew J. Evans; Daniel M. Barbieri

(57) ABSTRACT

The present invention is directed to a corner interconnect component which is a passive filter component. The corner interconnect component includes a body portion having an input structure located at a first corner of the component for receiving an input. At a second corner of the component, diagonally opposite the first corner, the component further includes an output structure for providing an output. The corner interconnect component further includes a conducting portion which is connected to the first and second corners of the body structure. The corner interconnect component is configured such that a plurality of the corner interconnect components may be implemented in a corner-to-corner configuration in a filter structure.

12 Claims, 2 Drawing Sheets

PASSIVE ELECTRICAL COMPONENT WITH A BODY WITH I/O STRUCTURE INCLUDING GROUND AT TWO OPPOSITE CORNERS OF THE BODY

FIELD OF THE INVENTION

The present invention relates to the field of advanced radio systems, and more particularly, to a corner interconnect component.

BACKGROUND OF THE INVENTION

For currently available passive devices (ex.—passive parts), the pad size required for even the smallest of said passive parts is often the same as the pad size required for larger passive devices. A device (ex.—part) which requires a large pad area in comparison to the size of the device may not result in a reduction in board area required for interconnect. For these currently available passive devices, reduction in the total area required for interconnect may not track (ex.—may not be proportional to) the size reduction of the individual piece parts.

Thus, it would be desirable to have a component for interconnecting small piece parts which addresses the problems associated with currently available solutions.

SUMMARY OF THE INVENTION

Accordingly an embodiment of the present invention is directed to a corner interconnect component, including: a body portion, the body portion including a first corner and a second corner, the second corner being located diagonally opposite the first corner, the first corner including a first corner I/O structure, the second corner including a second corner I/O structure; and a conducting portion, the conducting portion being connected to the first corner of the body portion, the conducting portion further being connected to the second corner of the body portion, wherein the corner interconnect component is configured for receiving an input via the first corner I/O structure and providing an output via the second corner I/O structure.

A further embodiment of the present invention is directed to a corner interconnect component, including: a body portion, the body portion including a first corner and a second corner, the second corner being located diagonally opposite the first corner, the first corner including a first corner I/O structure, the second corner including a second corner I/O structure, the first corner I/O structure including an input structure and a ground structure, the second corner I/O structure including an output structure and a ground structure; and a conducting portion, the conducting portion being connected to the first corner of the body portion, the conducting portion further being connected to the second corner of the body portion, wherein the corner interconnect component is configured for receiving an input via the input structure of the first corner I/O structure and providing an output via the output structure of the second corner I/O structure.

A still further embodiment of the present invention is directed to a corner interconnect component, including: a body portion, the body portion including a first corner, a second corner, the second corner being located diagonally opposite the first corner, a third corner, and a fourth corner, the fourth corner being located diagonally opposite the third corner, the first corner including a first corner I/O structure, the second corner including a second corner I/O structure, the first corner I/O structure including an input structure and a ground structure, the second corner I/O structure including an output structure and a ground structure; and a conducting portion, the conducting portion being connected to the first corner of the body portion, the conducting portion further being connected to the second corner of the body portion, the conducting portion being a coil-shaped portion formed of conducting wire, wherein the corner interconnect component is a passive component configured for receiving an input via the input structure of the first corner I/O structure and providing an output via the output structure of the second corner I/O structure.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Capacitors and inductors are fundamental building blocks in a number of products, such as bandpass filters, harmonic rejection low pass filters, shunt components (ex.—resonant LC structures), and Radio Frequency (RF) chokes. Any one of a number of processes may be utilized to integrate the active circuitry required for receiver, transmitter, power amplifier (PA) and/or modem functionality. Said active circuitry may include heterojunction bipolar transistors (HBT), Silicon Germanium (SiGe) semiconductors, pseudomorphic high electron mobility transistors (PHEMT), complementary metal-oxide-semiconductors (CMOS), and/or the like. Currently available filtering components occupy a major portion of existing board area (ex.—use large amounts of area in device interconnect). Further, currently available purchased lumped devices may include end plated interconnects which require a solder area and an interconnect area. Still further, currently available purchased lumped devices do not provide a path to integration with active devices. For example, a number of currently available filter devices (ex.—filtering components) are achieved with ceramic resonators, Bulk Acoustic Wave (BAW) devices, and Semiconductor Acoustic Wave (SAW) devices. However, ceramic filters are very large, while BAW and SAW devices have limited power handling capability and provide poor ultimate rejection.

In the exemplary embodiments of the present invention disclosed herein, a component corner interconnect which is configured for interconnecting small piece parts is provided which addresses the above-referenced shortcomings of currently available components and/or passive devices.

Figure 1:
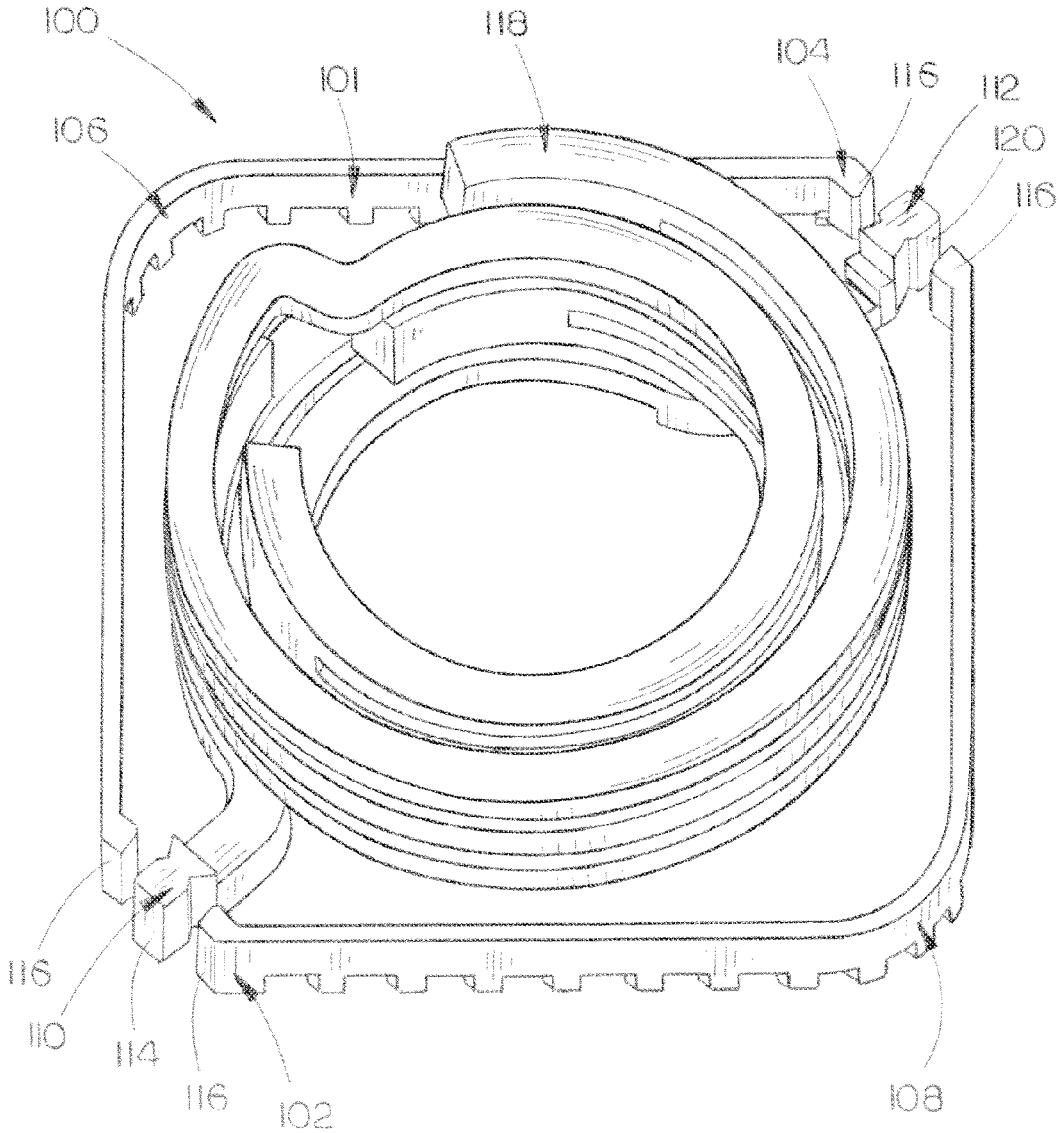
FIG. 1 is an isometric view of a corner interconnect component in accordance with an exemplary embodiment of the present invention.

Referring to FIG. 1 a corner interconnect component in accordance with an exemplary embodiment of the present invention is shown. In exemplary embodiments of the present invention, the corner interconnect component 100 is a four-sided component having four corners (exs—is a generally square-shaped component or a generally diamond-shaped component), the four sides forming a body portion 101 (ex.—a generally square-shaped or generally diamond-shaped body portion), said body portion 101 including four corners (102, 104, 106, 108). For example, the corner interconnect component 100 may include a first corner 102, a second corner 104 located diagonally opposite the first corner 102, a third corner 106, and a fourth corner 108 located diagonally opposite the third corner 106. In further embodiments of the present invention, the corner interconnect component 100 may be a passive component (exs.—a passive electrical component, a passive filter component), such as an inductor (ex.—a vertical inductor).

In current exemplary embodiments of the present invention, the corner interconnect component 100 may include a first corner input/output (I/O) structure 110. In further embodiments of the present invention, the first corner I/O structure 110 may form and/or may be located at the first corner 102 of the component 100. In still further embodiments of the present invention, the corner interconnect component 100 may include a second corner input/output (I/O) structure 112. In further embodiments of the present invention, the second corner I/O structure 112 may form and/or may be located at the second corner 104 of the component 100.

In exemplary embodiments of the present invention, the corner interconnect component 100 may be configured for receiving an input (exs.—an electrical input, an input signal) via the first corner I/O structure 110 of the corner interconnect component 100. For example, the first corner I/O structure 110 of the corner interconnect component 100 may include an input structure 114, the input structure 114 being configured for receiving an input. In still further embodiments of the present invention, the first corner I/O structure 110 of the corner interconnect component 100 may further include one or more ground structures 116. In exemplary embodiments of the present invention, the first corner I/O structure 110 of the corner interconnect component 100 may be connected to a conducting portion 118 (ex.—a coil-shaped portion formed of conducting wire) of the corner interconnect component 100.

In current exemplary embodiments of the present invention, the corner interconnect component 100 may be configured for providing an output (exs.—an electrical output, an output signal) via the second corner I/O structure 112 of the corner interconnect component 100. For example, the second corner I/O structure 112 of the corner interconnect component 100 may include an output structure 120, the output structure 120 being configured for providing an output. In still further embodiments of the present invention, the second corner I/O structure 112 of the corner interconnect component 100 may further include one or more ground structures 116. In current exemplary embodiments of the present invention, the second corner I/O structure 112 of the corner interconnect component 100 may be connected to the conducting portion 118 (ex.—a coil-shaped portion formed of conducting wire) of the corner interconnect component 100. For example, the corner interconnect component 100 may be configured for receiving an input (ex.—input signal) at the input structure 114, directing the received input from the input structure 114 to the conducting portion 118, providing a conductor output from the conducting portion 118 to the output structure 120, said conductor output being based upon said received input and further being based upon an electrical reactance of the conducting portion, then transmitting an output (ex.—output signal) from the output structure 120, said output structure output being based upon said conductor output and said received input.

Figure 2:
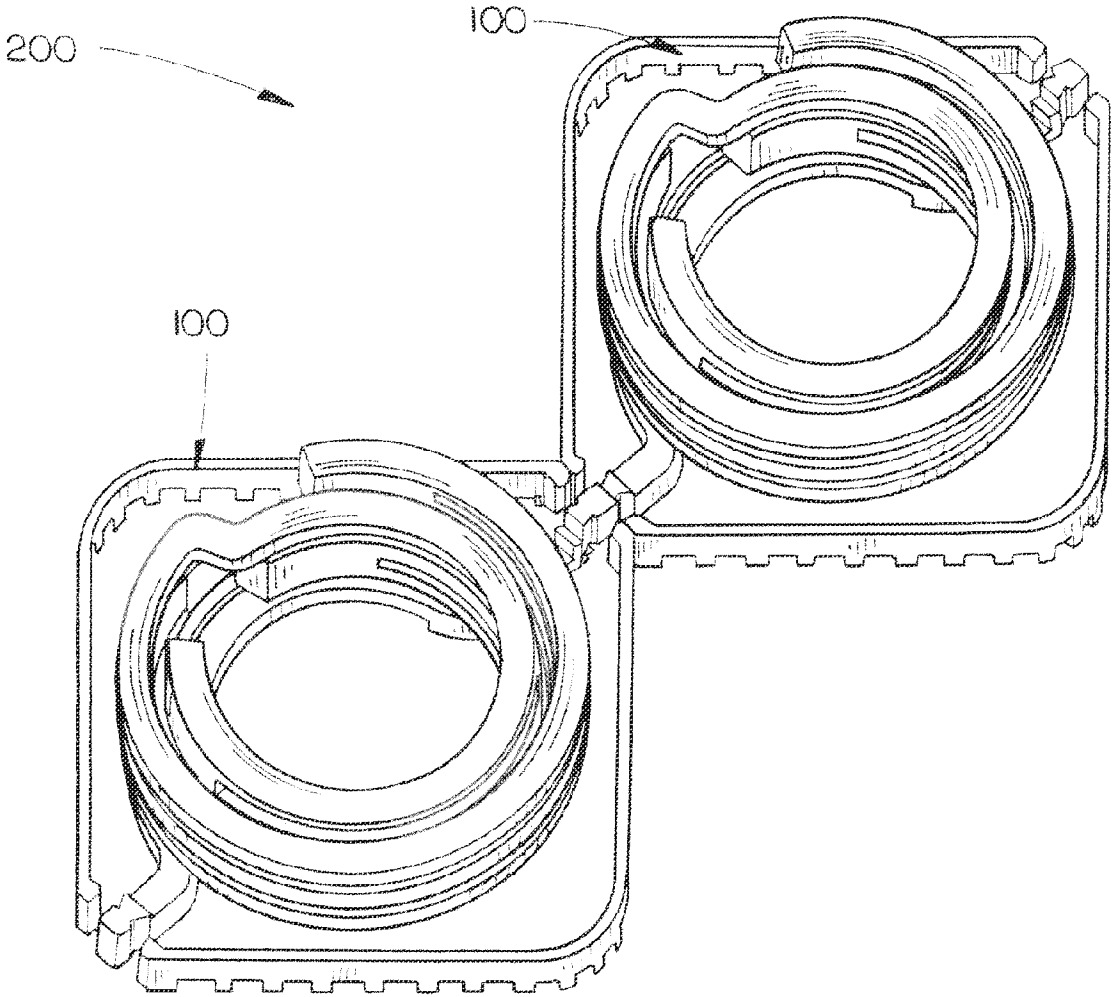
FIG. 2 is an isometric view of a filter structure, said filter structure including a plurality of corner interconnect components as shown in FIG. 1, said plurality of corner interconnect components being connected in a corner-to-corner configuration in accordance with an exemplary embodiment of the present invention.

In exemplary embodiments of the present invention, a plurality of corner interconnect components as described above may be connected to form a filter structure 200, as shown in FIG. 2. In exemplary embodiments, the filter structure 200 may include a first corner interconnect component 100 and a second corner interconnect component 100, the first corner interconnect component 100 being connected to the second corner interconnect component 100 in a corner-to-corner orientation, such that an output structure 120 of the first corner interconnect component 100 may be oriented towards (ex.—may be connected to) an input structure 114 of the second corner interconnect component 100. Thus, the corner I/O structures (110, 112) of the corner interconnect components 100 allow the corner interconnect components 100 to be interconnected in a corner-to-corner orientation (as shown in FIG. 2), which may allow the corner interconnect components 100 of the filter structure 200 to be pushed more tightly together and which may further allow the corner interconnect components 100 of the filter structure 200 to occupy a smaller footprint (ex.—take up a smaller area on a circuit board) than currently available components which are interconnected in an end-to-end or wall-to-wall arrangement. As a result, the filter structure 200 of the exemplary embodiments of the present invention may provide small filter functionality, while reducing interconnect parasitics. In further embodiments of the present invention, the corner interconnect component 100 may be configured for being connected in parallel with a surface mount passive component.

In current exemplary embodiments of the present invention, the corner interconnect components 100 may be formed or manufactured via any one of a number of various traditionally-implemented fabrication processes. For example, the fabrication processes may implement gold as the base metal for fabricating the components 100, thereby providing components 100 which may have a higher quality factor (Q) than components which are fabricated from nickel and may be easier to integrate with active die than components which are fabricated from copper, copper-beryllium, thin gold over nickel, titanium tungsten, titanium platinum, and/or copper over anodized aluminum. Further, the filter structure 200 may be fabricated as a single device implementing or including the same component structures 100 (ex.—proven components 100), thereby promoting improved (ex.—proven) performance of the filter structure 200.

In exemplary embodiments of the present invention, the corner interconnect components 100 (ex.—inductors) may each have an inductance value ranging from 1 nanohenry to 12 nanohenries (1 nH-12 nH). In further embodiments of the present invention, the corner interconnect components 100 (ex.—inductors) may each have a quality factor (Q) of approximately 160 at 1 Gigahertz (1 GHz). In still further embodiments of the present invention, the corner interconnect components 100 (ex.—inductors) may each occupy a footprint measuring 1905 micrometers by 1905 micrometers. In further embodiments of the present invention, the corner interconnect components 100 (ex.—inductors) may each have a complex impedance (ex.—reactance) of 720 ohms.

In current exemplary embodiments of the present invention, the corner interconnect components 100 may be implemented in and/or with various devices, such as in Quint Networking Technology Local Oscillation (QNT LO) rejection filters, Tactical Targeting Network Technology Local Oscillation (TTNT LO) rejection filters, Global Positioning System (GPS) diplexers, GPS filtering systems, shunt components (ex.—resonant LC structures), NavStrike devices and/or Ground Mobile Radio (GMR) devices.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A corner interconnect component, comprising:

a body portion, the body portion including a first corner and a second corner, the second corner being located diagonally opposite the first corner, the first corner including a first corner I/O structure, the second corner including a second corner I/O structure, the first corner I/O structure including an input structure and a ground structure, the input structure configured for receiving an input, the second corner I/O structure including an output structure and a ground structure, the output structure configured for providing an output; and a conducting portion, the conducting portion being connected to the first corner of the body portion, the conducting portion further being connected to the second corner of the body portion, wherein the component is a passive filter component.

2. A corner interconnect component as claimed in claim 1, wherein the body portion is one of: a generally square-shaped body portion and a generally diamond-shaped body portion.

3. A corner interconnect component as claimed in claim 1, wherein the body portion includes a third corner and a fourth corner, the third corner being located diagonally opposite the fourth corner.

4. A corner interconnect component as claimed in claim 1, wherein the component is an inductor.

5. A corner interconnect component as claimed in claim 1, wherein the conducting portion is a coil-shaped portion formed of conducting wire.

6. A corner interconnect component as claimed in claim 1, wherein the corner interconnect component is formed of gold.

7. A corner interconnect component as claimed in claim 1, wherein the component is configured for directing the received input to the conducting portion, providing a conductor output from the conducting portion to the output structure, said conductor output being based upon the received input and further being based upon an electrical reactance of the conducting portion, and providing the output via the output structure, said output being based upon the conductor output and the received input.

8. A corner interconnect component as claimed in claim 1, wherein the first corner of the corner interconnect component is configured for being connected to and oriented towards an output structure of a second corner interconnect component.

9. A corner interconnect component as claimed in claim 1, wherein the second corner of the corner interconnect component is configured for being connected to and oriented towards an input structure of a second corner interconnect component.

10. A corner interconnect component as claimed in claim 8, wherein the corner interconnect component is implemented with the second corner interconnect component in a filter structure.

11. A corner interconnect component as claimed in claim 10, wherein the filter structure is one of: a Quint Networking Technology Local Oscillation (QNT LO) rejection filter, a Tactical Targeting Network Technology Local Oscillation (TTNT LO) rejection filter, and a Global Positioning System (GPS) filtering system.

12. A corner interconnect component as claimed in claim 8, wherein the corner interconnect component is implemented with the second corner interconnect component in a device, the device being one of: a Mini-Common Data Link (Mini-CDL) diplexer, a Global Positioning System (GPS) diplexer, a NavStrike device and a Ground Mobile Radio (GMR) device.

* * * * *